US011484896B2

(12) United States Patent
Kurchev et al.

(10) Patent No.: US 11,484,896 B2
(45) Date of Patent: Nov. 1, 2022

(54) FLUID DISPENSER AND FIRST AND SECOND FLUID CONTAINERS FOR A FLUID DISPENSER

(71) Applicant: GOJO Industries, Inc., Akron, OH (US)

(72) Inventors: Aaron Michael Kurchev, Atwater, OH (US); Nick Ermanno Ciavarella, Seven Hills, OH (US); Michael Gallo, Twinsburg, OH (US); John James McNulty, Broadview Heights, OH (US)

(73) Assignee: GOJO Industries, Inc, Akron, OH (US)

( * ) Notice: Subject to any disclaimer, the term of this patent is extended or adjusted under 35 U.S.C. 154(b) by 192 days.

(21) Appl. No.: 16/908,077

(22) Filed: Jun. 22, 2020

(65) Prior Publication Data

US 2021/0008576 A1 Jan. 14, 2021

Related U.S. Application Data

(62) Division of application No. 15/927,071, filed on Mar. 20, 2018, now Pat. No. 10,688,507, which is a division of application No. 15/000,185, filed on Jan. 19, 2016, now Pat. No. 9,919,323.

(60) Provisional application No. 62/110,810, filed on Feb. 2, 2015.

(51) Int. Cl.

| | |
|---|---|
| ***B05B 7/02*** | (2006.01) |
| ***B05B 7/24*** | (2006.01) |
| ***A47K 5/12*** | (2006.01) |
| ***B05B 15/65*** | (2018.01) |

(52) U.S. Cl.

CPC ..... *B05B 7/02* (2013.01); *A47K 5/1207* (2013.01); *B05B 7/24* (2013.01); *B05B 15/65* (2018.02)

(58) Field of Classification Search

CPC .... B65D 83/203; B65D 83/42; A47K 5/1207; B05B 7/24; B05B 7/02; B05B 15/65

USPC ..... 222/145.1

See application file for complete search history.

(56) References Cited

U.S. PATENT DOCUMENTS

| | | | | | |
|---|---|---|---|---|---|
| 3,181,737 | A * | 5/1965 | Chaucer | B65D 83/687 | 141/20 |
| 3,283,960 | A * | 11/1966 | Williams | B65D 83/70 | 222/397 |
| 5,179,982 | A * | 1/1993 | Berube | B65B 31/003 | 222/105 |
| 5,556,005 | A * | 9/1996 | Banks | A47K 5/1207 | 222/105 |
| 5,586,695 | A * | 12/1996 | Labus | B65D 83/38 | 222/394 |
| 6,073,812 | A * | 6/2000 | Wade | B65D 51/1616 | 222/189.09 |
| 7,850,049 | B2 * | 12/2010 | Ciavarella | B05B 11/3047 | 222/190 |

(Continued)

*Primary Examiner* — Benjamin R Shaw

(74) *Attorney, Agent, or Firm* — Cooper Legal Group LLC

(57) ABSTRACT

A refillable fluid container for a fluid dispenser is provided. The refillable fluid dispenser includes a body, an output port and a dispensing mechanism. The body includes at least one wall that defines a reservoir for storing fluid therein. The output port is in fluid communication with the reservoir. The dispensing mechanism is associated with the output port. The dispensing mechanism is selectively operable between a closed position and an opened position. A fluid dispenser is also provided.

20 Claims, 6 Drawing Sheets

(56) References Cited

U.S. PATENT DOCUMENTS

| | | | | |
|---|---|---|---|---|
| 8,267,284 | B2 * | 9/2012 | Ray | B05B 11/3098 222/145.5 |
| 8,544,692 | B2 * | 10/2013 | Rusch | B67D 1/0889 222/404 |
| 2006/0175354 | A1 * | 8/2006 | Ophardt | A47K 5/1202 222/188 |
| 2007/0284371 | A1 * | 12/2007 | Anderson | B65D 7/045 222/397 |
| 2013/0112714 | A1 * | 5/2013 | Ho | A47K 5/1207 222/181.3 |
| 2014/0263462 | A1 * | 9/2014 | Quinlan | B05B 11/3087 222/190 |
| 2016/0213203 | A1 * | 7/2016 | Pelfrey | B05B 7/2464 |
| 2016/0256015 | A1 * | 9/2016 | Ophardt | A47K 5/14 |
| 2017/0027391 | A1 * | 2/2017 | Jones | B05B 11/3087 |
| 2017/0055782 | A1 * | 3/2017 | Ophardt | A47K 5/1207 |
| 2017/0056907 | A1 * | 3/2017 | Ophardt | F04B 53/14 |

* cited by examiner

FLUID DISPENSER AND FIRST AND SECOND FLUID CONTAINERS FOR A FLUID DISPENSER

CROSS-REFERENCE TO RELATED APPLICATIONS

This application is a divisional of and claims priority to U.S. Non-Provisional patent application Ser. No. 15/927,071, titled "FLUID DISPENSER AND FIRST AND SECOND FLUID CONTAINERS FOR A FLUID DISPENSER" and filed on Mar. 20, 2018, which is a divisional of and claims priority to U.S. patent application Ser. No. 15/000,185, titled "FLUID DISPENSER AND FIRST AND SECOND FLUID CONTAINERS FOR A FLUID DISPENSER" and filed on Jan. 19, 2016, which claims priority to U.S. Provisional Patent Application No. 62/110,810, titled "FLUID DISPENSER AND FIRST AND SECOND FLUID CONTAINERS FOR A FLUID DISPENSER" and filed on Feb. 2, 2015. U.S. Non-Provisional patent application Ser. No. 15/927,071, U.S. Non-Provisional patent application Ser. No. 15/000,185, and U.S. Provisional Patent Application No. 62/110,810 are incorporated herein by reference in their entireties.

TECHNICAL FIELD

A fluid dispenser assembly includes first and second fluid containers that are selectively installable in a fluid dispenser. The first fluid container is refillable from the second fluid container.

BACKGROUND

Conventional cartridge based soap dispensers use disposable refill cartridges. These disposable refill cartridges are single-use type cartridges and thus incapable of being refilled.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, a first fluid container and a second fluid container are provided. At least one of the first fluid container or the second fluid container comprises a body comprising at least one wall that defines a reservoir for storing fluid therein. An input port is in fluid communication with the reservoir. An output port is in fluid communication with the reservoir. A dispensing mechanism is associated with the output port. The dispensing mechanism is selectively operable between a closed position and an opened position. The output port of the second fluid container is configured for insertion into the input port of the first fluid container. When the output port of the second fluid container is inserted into the input port of the first fluid container, the first fluid container facilitates movement of the dispensing mechanism into an opened position to facilitate dispensation of fluid from the reservoir of the second fluid container, through the output port of the second fluid container, through the input port of the first fluid container, and into the reservoir of the first fluid container.

In another example, a fluid container comprises a body comprising at least one wall that defines a reservoir for storing fluid therein. An input port is in fluid communication with the reservoir. An output port is in fluid communication with the reservoir. A dispensing mechanism is associated with the output port. The dispensing mechanism is selectively operable between a closed position, in which the fluid is not dispensed from the reservoir, and an opened position, in which the fluid is dispensed from the reservoir. The output port is configured to interface with at least one of a second input port of a second fluid container or a support of a housing. The input port is configured to interface with a third output port of a third fluid container.

In another example, a fluid container comprises a body comprising at least one wall that defines a reservoir for storing fluid therein. An input port is in fluid communication with the reservoir. An output port is in fluid communication with the reservoir. A dispensing mechanism is associated with the output port. The dispensing mechanism is selectively operable between a closed position, in which the fluid is not dispensed from the reservoir, and an opened position, in which the fluid is dispensed from the reservoir. The output port is configured to interface with a support of a housing. The input port is configured to interface with a second output port of a second fluid container. When the second output port of the second fluid container interfaces with the input port, the dispensing mechanism is selectively operable to move from the closed position to the opened position to facilitate dispensation of a second fluid from a second reservoir of the second fluid container, through the second output port of the second fluid container, through the input port, and into the reservoir of the fluid container.

The following description and annexed drawings set forth certain illustrative aspects and implementations. These are indicative of but a few of the various ways in which one or more aspects can be employed. Other aspects, advantages, and/or novel features of the disclosure will become apparent from the following detailed description when considered in conjunction with the annexed drawings.

DETAILED DESCRIPTION

Figure 1:
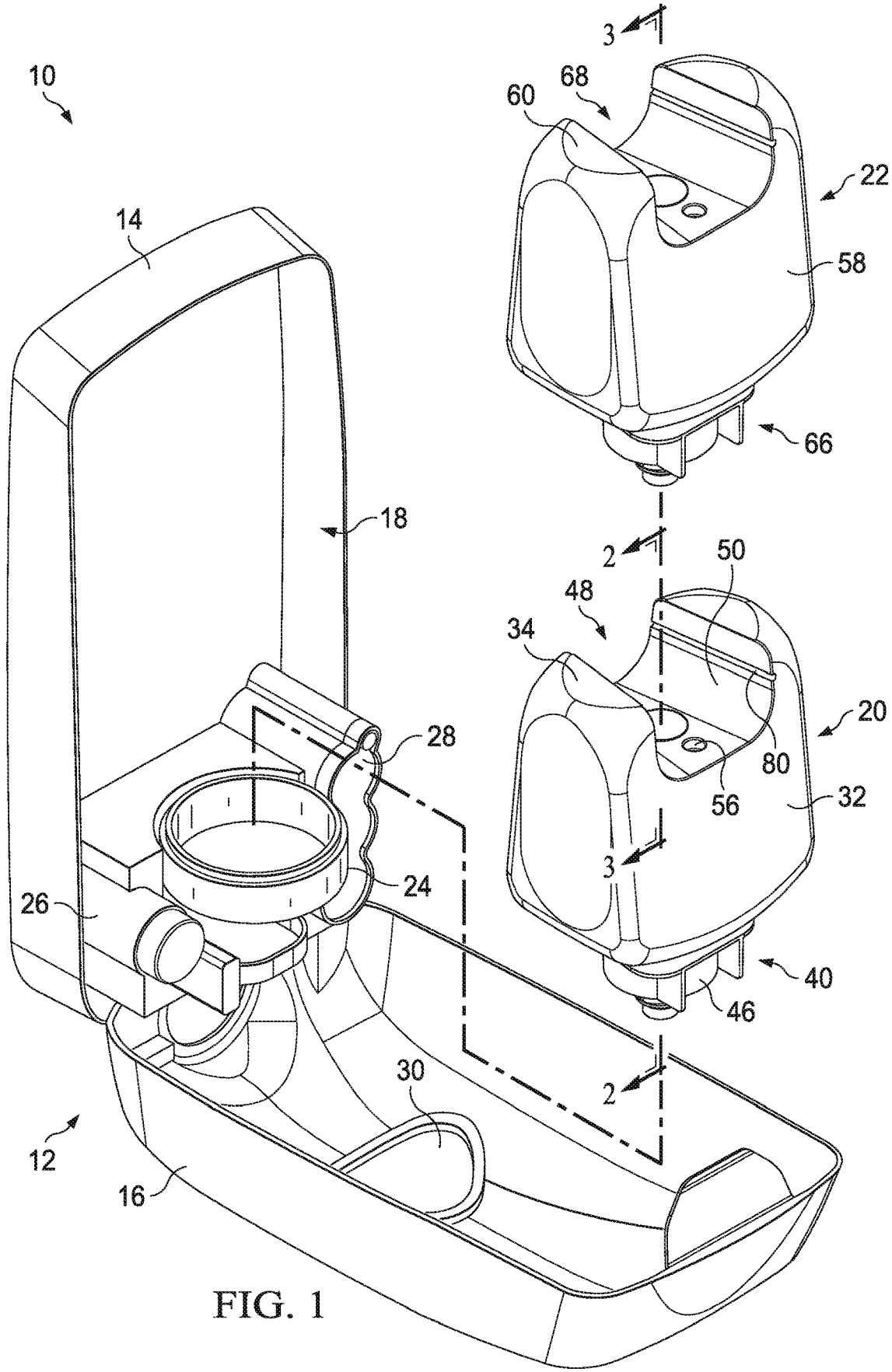
FIG. 1 is front perspective view depicting a fluid dispenser in association with a pair of refill bottles according to one embodiment, wherein a lid of the fluid dispenser is shown in an opened position.

Embodiments are hereinafter described in detail in connection with the views of FIGS. 1-6, wherein like numbers indicate the same or corresponding elements throughout the views. FIG. 1 illustrates a fluid dispenser 10 which can dispense a variety of different types of fluids or liquids, such as, for example, soap, sanitizer, soil removing cleaner, lotion, shampoo, or conditioner, to the hands of a user. The fluid dispenser 10 can include a housing 12 that includes a base 14 and lid 16. The base 14 and the lid 16 can cooperate to define an interior chamber 18, which can house various components of the fluid dispenser 10, and can be configured to receive first and second fluid containers 20, 22. The lid 16 can be pivotable with respect to the base 14 to permit installation and replacement of the first and second fluid containers 20, 22.

The fluid dispenser 10 can include a lower support 24 that is configured to support the first fluid container 20. The fluid dispenser 10 can also include a motor 26 and batteries 28 for powering the motor 26. With the first fluid container 20 installed on the lower support 24, the motor 26 can actuate a pump (not shown) to facilitate dispensation of fluid onto a user's hands placed below. The fluid dispenser 10 can include a proximity sensor (not shown) or other detection device that defines a detection zone (not shown) below the fluid dispenser 10. A user can actuate the fluid dispenser 10 by placing his/her hands (or other object) within the detection zone, which can initiate operation of the motor 26 to dispense fluid onto the user's hands. In an alternative embodiment, a user can actuate the fluid dispenser 10 by manually actuating a push bar (not shown) that facilitates dispensation of fluid onto the user's hands.

Figure 2:
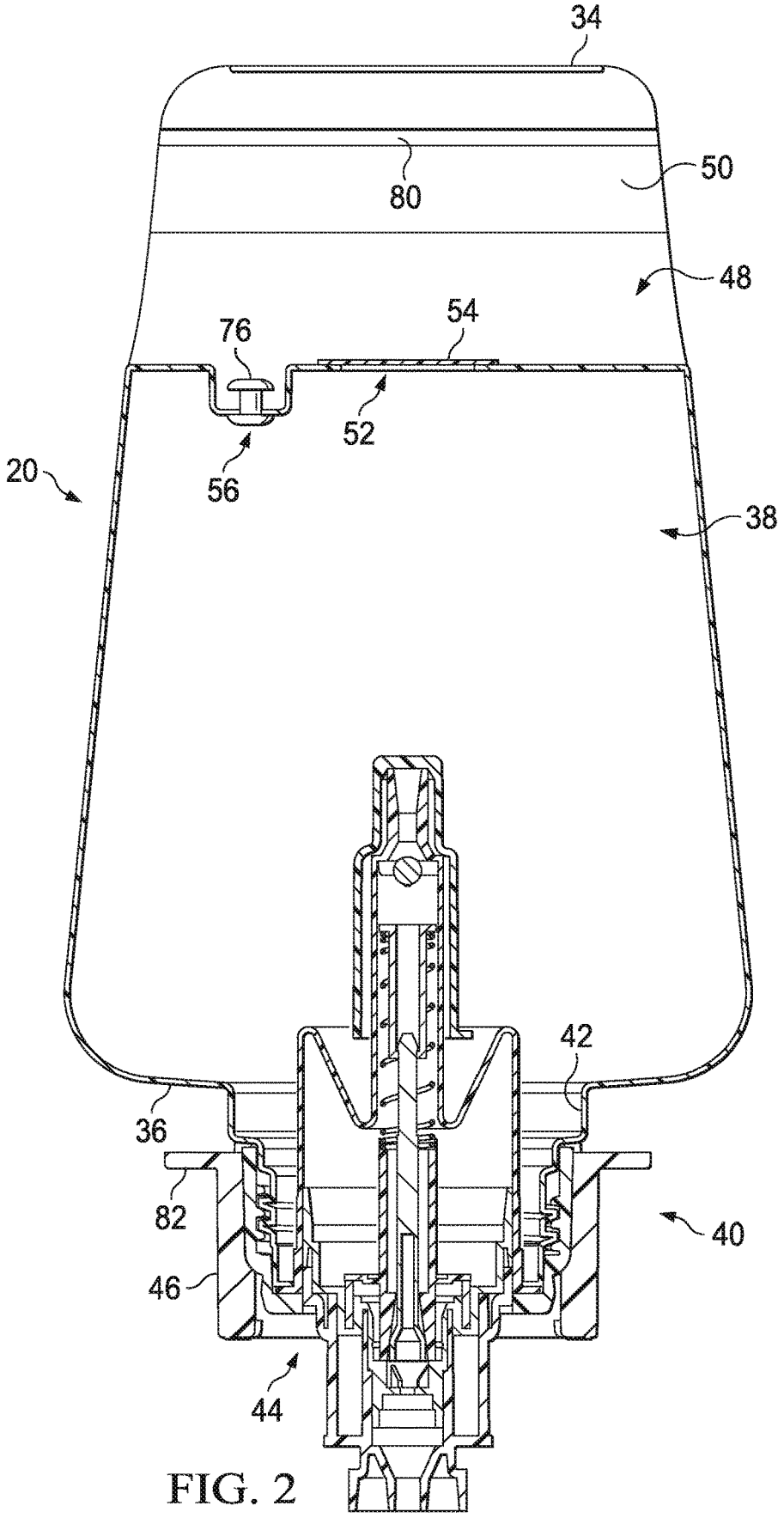
FIG. 2 is a cross section view taken along the line 2-2 in FIG. 1.

As shown in FIGS. 1 and 2, the lid 16 can define a viewing window 30, which can facilitate viewing into the interior chamber 18 defined by the base 14 and lid 16, for example, to determine whether the first fluid container 20 is disposed within the fluid dispenser 10 and/or to determine the fill level of the first fluid container 20.

The first fluid container 20 can include a sidewall 32, an upper wall 34, and a lower wall 36 that cooperate with one another to define a reservoir 38 for storing fluid or liquid to be dispensed from the fluid dispenser 10. An output port 40 can be provided at the lower wall 36 and can be in fluid communication with the reservoir 38. The output port 40 can include a neck portion 42 and a flow pump 44 that is releasably secured to the neck portion 42 by a collar member 46. When the first fluid container 20 is installed in the fluid dispenser 10, the collar member 46 can be supported by the lower support 24 with the flow pump 44 extending therethrough such that the lower support 24 does not obstruct dispensation of fluid from the flow pump 44 to the dispensation zone. The output port 40 of the first fluid container 20 can further include a circumferential flange 82 to releasably secure the first fluid container 20 to another fluid container.

The flow pump 44 can be movable between an opened position and closed position to facilitate selective dispensation of fluid from the output port 40. The flow pump 44 can be biased into the closed position, such as with a biasing member (not shown), to prevent fluid from inadvertently being dispensed from the output port 40. The flow pump 44 can be associated with the motor 26 which can facilitate selective opening of the flow pump 44 to dispense fluid from the first fluid container 20. It is to be appreciated that although a flow pump is described as controlling dispensation of fluid from the output port 40, any of a variety of suitable alternative dispensation mechanisms can be provided, such as, for example, a valve.

The first fluid container 20 can also include an input port 48 that is defined by the upper wall 34 and in fluid communication with the reservoir 38. Referring now to FIG. 2, the input port 48 of the first fluid container 20 can include a concave wall 50 that defines an aperture 52. A sealing member 54 can be associated with the aperture 52 for selectively sealing the input port 48 to prevent fluid from inadvertently leaking from the aperture 52. A vent 56 can be provided in the concave wall 50. The vent 56 can be in fluid communication with the reservoir 38 and configured to facilitate venting of air from the reservoir 38 (e.g., during refilling of the first fluid container 20).

Referring again to FIGS. 1 and 3, the second fluid container 22 can be similar to, or the same as in many respects, the first fluid container 20 illustratively shown in FIGS. 1 and 2. For example, the second fluid container 22 can include a sidewall 58, an upper wall 60, and a lower wall 62 that cooperate with one another to define a reservoir 64. The second fluid container 22 can further include an output port 66 and an input port 68. The output port 66 can include a neck portion 70, a flow pump 72, and a collar member 74.

Figure 3:
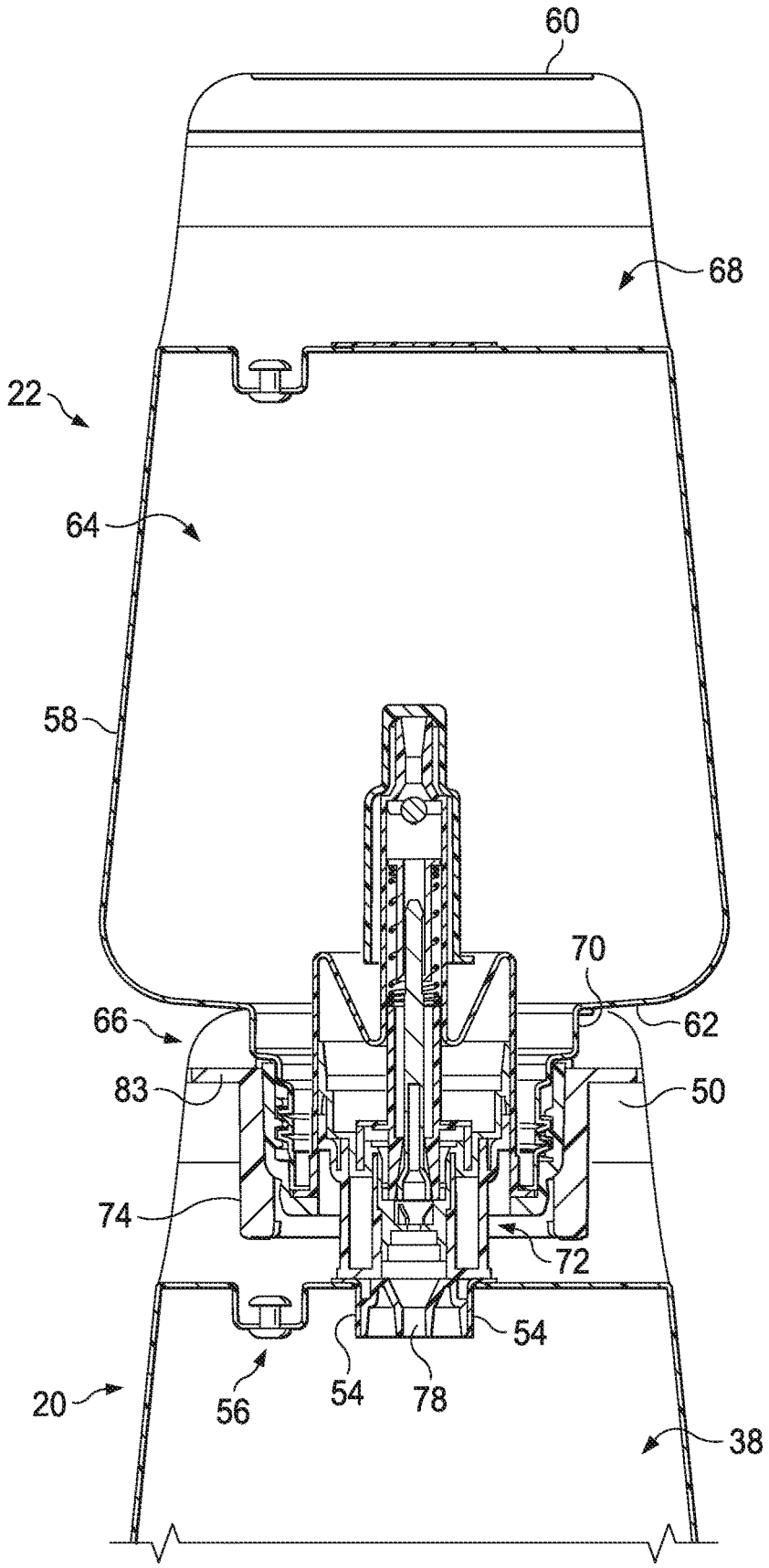
FIG. 3 is a cross section view taken along the line 3-3 in FIG. 1 depicting the pair of refill bottles of FIG. 1 but with one of the refill bottles shown mounted on top of the other refill bottle.

As illustrated in FIG. 3, the output port 66 of the second fluid container 22 can be inserted into the input port 48 of the first fluid container 20 to facilitate refilling of the first fluid container 20 with the second fluid container 22. When the output port 66 is inserted into the input port 48, the flow pump 72 can extend through the sealing member 54, through the aperture 52, and into the reservoir 38. In one embodiment, the sealing member 54 of the input port 48 can be formed of a frangible material, such as foil, that is irreparably punctured by the output port 66 (e.g., a single use-type seal). In another embodiment, the sealing member 54 can be formed of a resilient material, such as an elastomeric material, that allows for repeated sealing of the aperture 52 when the output port 66 is removed from the aperture 52 (e.g., a self-sealing seal).

When the output port 66 of the second fluid container 22 is inserted into the input port 48 of the first fluid container 20, the first fluid container 20 can facilitate movement of the flow pump 72 into an opened position to facilitate dispensation of fluid from the reservoir 64 of the second fluid container 22. For example, when the output port 66 is inserted into the aperture 52, the concave wall 50 of the input port 48 can contact a tip portion 78 of the flow pump 72 and can urge it into the opened position such that the reservoirs 38, 64 are in fluid communication with each other. Fluid from the second fluid container 22 can thus flow from the reservoir 64, through the output port 66, and into the reservoir 38 of the first fluid container 20 thus refilling the first fluid container 20. As the first fluid container 20 is being refilled, air from the reservoir 38 can urge a plunger 76 of the vent 56 into an opened position to allow air to exhaust therethrough.

In one embodiment, the output port 66 of the second fluid container 22 and the input port 48 of the first fluid container 20 can be configured for selective retention with each other. As illustrated in FIG. 3, the concave wall 50 of the first fluid container 20 can include a groove 80 that is proximate the upper wall 34. The output port 66 of the second fluid container 22 can similarly include a circumferential flange 83. When the second fluid container 22 is installed on the first fluid container 20, the circumferential flange 93 of the output port 66 can extend into the groove 80 of the input port 48 to releasably secure the first and second fluid containers 20, 22 together in a snap-fit type arrangement. It is to be appreciated that the first and second fluid containers 20, 22 can be provided with any of a variety of suitable alternative retention features, such as, for example, corresponding threads that facilitate threaded engagement between the input and output ports 48, 66.

The first fluid container 20 can be configured as a one-time refillable container that includes a feature (not shown) that is activated upon removal of the second fluid container 22 to prevent additional refill containers from being installed on the first fluid container 20. In one embodiment, the concave wall 50 of the first fluid container 20 can include a frangible portion (not shown) that breaks away and extends upwardly from the concave wall 50 when the second fluid container 22 is removed. The frangible portion can extend far enough from the concave wall 50 to obstruct another fluid container from being fully installed into the input port 48 of the first fluid container 20. In another embodiment, in lieu of the circumferential groove 80, the concave wall 50 can include tabs (not shown) that are configured to grasp the circumferential flange 83 of the output port 66. The tabs can be configured to break away when the second fluid container 22 is removed to prevent another fluid container from being properly retained to the first fluid container 20. In yet another embodiment, the portion of the concave wall 50 that defines the aperture 52 can break away to define a larger aperture. When a refill container (e.g., a third fluid container) is installed onto the first fluid container 20, the aperture is too large to allow the concave wall to push the flow pump of the refill container open, thus rendering the refill container inoperable.

Refilling of the first fluid container 20 with the second fluid container 22 can be a more cost effective and less wasteful refill solution than some conventional fluid dispenser refill arrangements. For example, conventional self-contained refill cartridges (i.e., non-refillable) must be replaced each time the fluid dispenser should be refilled. For fluid dispensers that are refilled according to a predefined schedule (e.g., weekly), the installed cartridge is oftentimes replaced irrespective of whether any fluid still remains in the cartridge thus resulting in excess waste and cost. The fluid dispenser 10, however, can be refilled with the second fluid container 22 to supplement the fluid in the first fluid container 20 which can thus be more cost effective and less wasteful than conventional arrangements.

In one embodiment, the first and second fluid containers 20, 22 can be substantially identical such that the first or second fluid container 20, 22 are interchangeable. The first and second fluid containers 20, 22 can thus be capable of being installed as either the top container or the bottom container in the fluid dispenser 10 which can encourage efficient installation in the fluid dispenser 10. In addition, since the first and second fluid containers 20, 22 are substantially identical, the same refill cartridge can be used to replace either fluid container 20, 22 thus alleviating the need for different cartridge types for the fluid dispenser 10.

Figure 4:
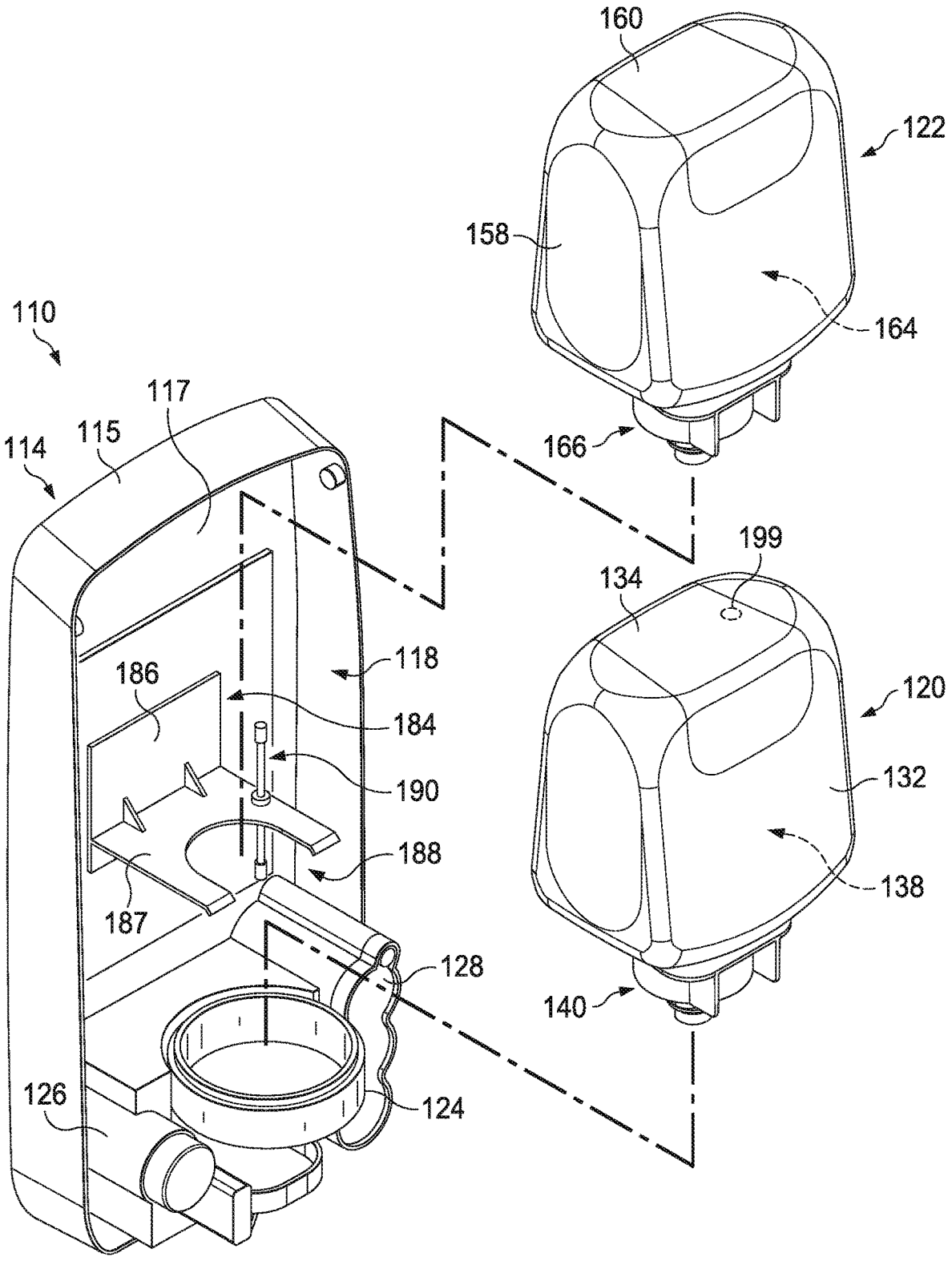
FIG. 4 is front perspective view depicting a fluid dispenser in association with a pair of refill bottles according to another embodiment, wherein a lid of the fluid dispenser has been removed for clarity of illustration.
Figure 5:
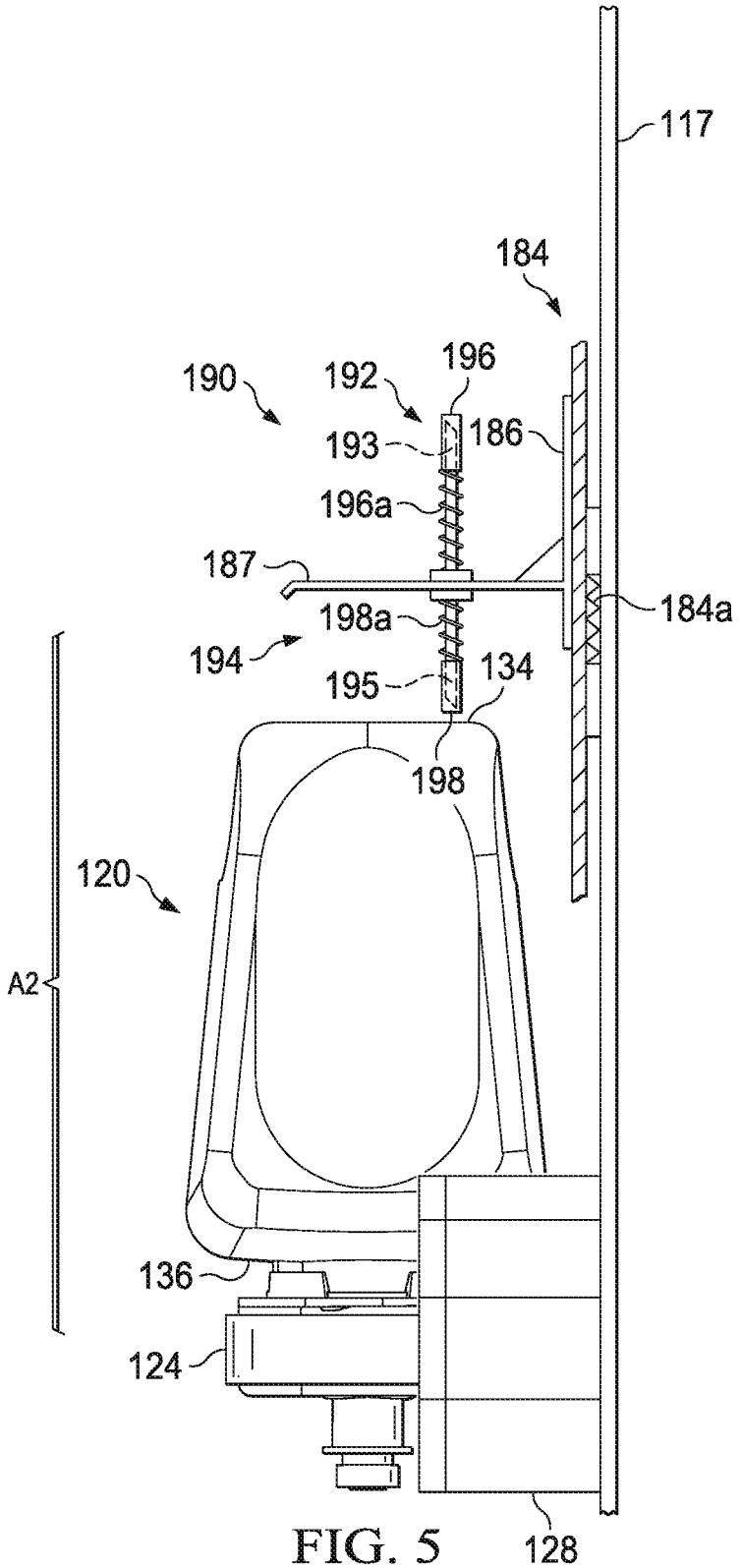
FIG. 5 is a cross section view depicting the fluid dispenser of FIG. 4, with one of the refill bottles shown installed in the fluid dispenser.
Figure 6:
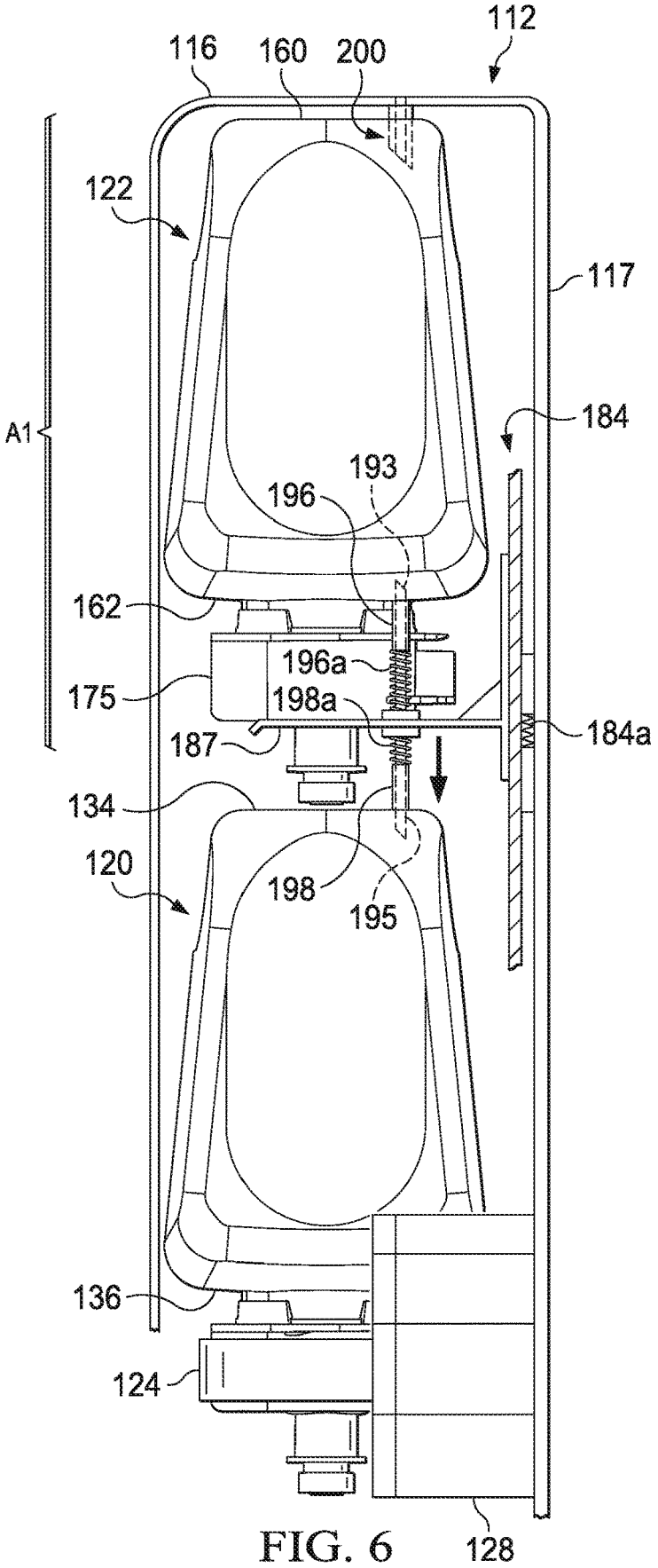
FIG. 6 is a cross section view similar to FIG. 4, but with the other refill bottle shown installed in the fluid dispenser above the refill bottle of FIG. 4 and with a lid of the fluid dispenser shown in a closed position.

FIGS. 4-6 illustrate a fluid dispenser 110 according to another embodiment. The fluid dispenser 110 can be similar to, or the same in many respects as, the fluid dispenser 10 illustrated in FIG. 1. For example, the fluid dispenser 110 can include a housing 112 (FIG. 6) that includes a base 114 and lid 116 (FIG. 6) that cooperate to define an interior chamber 118. The fluid dispenser 110 can also include a lower support 124, a motor 126 and batteries 128 for powering the motor 126. However, the fluid dispenser 110 can include an upper support 184 that will be described in more detail below. A first fluid container 120 can be supported by the lower support 124 and a second fluid container 122 can be supported by the upper support 184.

The first and second fluid containers 120, 122 can be similar to, or the same in many respects as, the first and second fluid containers 20, 22 illustrated in FIGS. 1-3. For example, the first fluid container 120 can include a sidewall 132, an upper wall 134, a lower wall 136, a reservoir 138, and an output port 140. The second fluid container 122 can include a sidewall 158, an upper wall 160, a lower wall 162, a reservoir 164, and an output port 166. However, each of the first and second fluid containers 120, 122 might not include respective input ports (e.g., 48, 68) configured for receipt of an output port (e.g., 40, 66) from another fluid container.

As illustrated in FIG. 4, the upper support 184 can be disposed between the lower support 124 and the upper wall 115 of the base 114 of the housing 112. The upper support 184 can include a back portion 186 and a support portion 187 that extends substantially horizontally from the back portion 186. The support portion 187 can define a substantially U-shaped slot 188 for receiving the second fluid container 122. When the second fluid container 122 is installed on the support portion 187, a collar member 175 of the second fluid container 122 can be retained within the U-shaped slot 188 (e.g., through frictional engagement) such that the second fluid container 122 is supported by the upper support 184.

Referring again to FIGS. 4-6, a hollow conduit 190 can be coupled with the support portion of the upper support 184 adjacent to the U-shaped slot 188. The hollow conduit 190 can include an upper end 192 and a lower end 194. The upper end 194 can extend into an upper area A1 defined between the upper support 184 and the upper wall 115 of the base 114 of the housing 112. The lower end 194 can extend into a lower area A2 defined between the lower support 124 and the upper support 184. In one embodiment, as illustrated in FIGS. 5 and 6, the upper and lower ends 192, 194 can include respective barbed tips 193, 195.

The hollow conduit 190 can include upper and lower sleeves 196, 198 that surround the hollow conduit 190 at the respective upper and lower ends 192, 194. Each of the upper and lower sleeves 196, 198 can be slidably coupled with the hollow conduit 190 and slidable between a concealing position (FIG. 5) and a revealing position (FIG. 6). As illustrated in FIG. 5, the barbed tips 193, 195 can be concealed when the upper and lower sleeves 196, 198 are in their respective concealing positions. As illustrated in FIG. 6, the barbed tips 193, 195 can be revealed when the upper and lower sleeves 196, 198 are in their respective revealing positions. In one embodiment, the upper and lower sleeves 196, 198 can be biased into their respective concealing positions by respective springs 196*a*, 198*a* to prevent a user from inadvertently contacting the barbed tips 193, 195.

The upper support 184 can be slidably coupled with a rear wall 117 of the base 114 of the housing 112 and slidable between a released position (FIG. 5) and an actuated position (FIG. 6). The upper support 184 can be biased into the released position by a spring 184*a*. When the upper support 184 is in the released position, as illustrated in FIG. 5, the lower support 124 and the upper support 184 are spaced apart enough to allow the first fluid container 120 to be installed in the lower area A2 of the fluid dispenser 110 without being adversely contacted by the lower end 194 of the hollow conduit 190. Once the first fluid container 120 is installed in the fluid dispenser 110, the upper support 184 can be slid to the actuated position, as illustrated in FIG. 6, to provide sufficient clearance between the upper wall 115 of the base 114 and the upper support 184 for the second fluid container 122. When the upper support 184 is slid into the actuated position, the barbed tip 195 at the lower end 194 of the hollow conduit 190 can puncture the first fluid container 120 such that the lower end 194 extends into, and is in fluid communication with, the reservoir 138 (shown in FIG. 4).

The upper wall 134 of the first fluid container 120 can include frangible area 199 (FIG. 4) that encourages puncturing of the upper wall 134 with the barbed tip 195.'

The second fluid container 122 can then be installed on the upper support 184 by inserting the output port 166 into the U-shaped slot 188 with the second fluid container 122 at an angle. It is to be appreciated that, in some embodiments, the output port 166 can be inserted into the U-shaped slot 188 with enough downward force to cause the upper support 184 to move to the actuated position simultaneously with the installation of the second fluid container 122, while in other embodiments, the upper support 184 can be moved to the actuated position prior to installation of the second fluid container 122 (e.g., with a user's hand).

The second fluid container 122 can then be pivoted into the upright position which can cause the barbed tip 193 of the upper end 192 of the hollow conduit 190 to pierce the lower wall 162 of the second fluid container 122 and allow the upper end 192 of the hollow conduit 190 to extend into the reservoir 164. The lower wall 162 of the second fluid container 122 can include a frangible area (similar to 199) that allows for easy puncturing of the lower wall 162 with the barbed tip 193.

The reservoirs 138, 164 of the first and second fluid containers 120, 122 can be in fluid communication with each other via the hollow conduit 190 to allow refill fluid from the second fluid container 122 to flow from the reservoir 164, through the hollow conduit 190, and into the reservoir 138 of the first fluid container 120.

Once the first and second fluid containers 120, 122 are properly installed in the housing 112, the lid 116 can be secured to the base 114. As illustrated in FIG. 6, an upper puncture member 200 of the lid 116 can puncture the upper wall 160 of the second fluid container 122. As the first fluid container 120 is being refilled, air can be introduced into the reservoir 164 of the second fluid container 122 through the puncture member 200 to encourage the dispensation of fluid from the second fluid container 122.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather it is hereby intended the scope be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A fluid container, comprising:

a body comprising at least one wall that defines a reservoir for storing fluid therein;

an output port in fluid communication with the reservoir; and a dispensing mechanism associated with the output port, the dispensing mechanism being selectively operable between a closed position and an opened position, wherein:

a first frangible area is disposed on the body on a diametrically opposite side of the reservoir relative to the output port, the at least one wall comprises a lower wall, an upper wall, and a side wall extending between the lower wall and the upper wall, the first frangible area is disposed on the upper wall, and the lower wall defines a portion for receiving a conduit, the portion for receiving the conduit laterally offset from the output port.

2. The fluid container of claim 1, wherein the first frangible area comprises a foil material.

3. The fluid container of claim 1, wherein:

the output port comprises a neck portion and a collar member, and the dispensing mechanism comprises a flow pump that is releasably secured to the neck portion by the collar member.

4. The fluid container of claim 3, wherein:

the output port comprises a flange protruding from the collar member.

5. The fluid container of claim 3, wherein the flow pump comprises a biasing member to bias the flow pump into the closed position.

6. The fluid container of claim 1, wherein the dispensing mechanism comprises a biasing member to bias the dispensing mechanism into the closed position.

7. The fluid container of claim 1, wherein the first frangible area comprises a material that is irreparably damaged upon being punctured.

8. A fluid container, comprising:

a body comprising at least one wall that defines a reservoir for storing fluid therein;

an output port in fluid communication with the reservoir; and a dispensing mechanism associated with the output port, the dispensing mechanism being selectively operable between a closed position and an opened position, wherein:

a first frangible area is disposed on the body on a same side of the reservoir as the output port, the output port comprises a neck portion and a collar member, and the dispensing mechanism comprises a flow pump that is releasably secured to the neck portion by the collar member.

9. The fluid container of claim 8, wherein:

the output port extends from a lower wall of the body, and the first frangible area is disposed on the lower wall and laterally offset from the output port.

10. The fluid container of claim 8, comprising:

a second frangible area disposed on the body on a diametrically opposite side of the reservoir relative to the output port and the first frangible area.

11. The fluid container of claim 8, wherein the first frangible area comprises a foil material.

12. The fluid container of claim 8, wherein the first frangible area comprises a material that is irreparable damaged upon being punctured.

13. A fluid container, comprising:

a body comprising at least one wall that defines a reservoir for storing fluid therein;

an output port in fluid communication with the reservoir; and a dispensing mechanism associated with the output port, the dispensing mechanism being selectively operable between a closed position and an opened position, wherein:

the body defines a first fluid transport port, the body defines a second fluid transport port, and the second fluid transport port is on a diametrically opposite side of the reservoir relative to the first fluid transport port.

14. The fluid container of claim 13, wherein the first fluid transport port and the output port are on a same side of the reservoir.

15. The fluid container of claim 13, wherein:

the output port extends from a lower wall of the body, and the first fluid transport port is disposed on the lower wall and laterally offset from the output port.

16. The fluid container of claim 13, comprising:

a frangible member covering the first fluid transport port.

17. A fluid container, comprising:

a body comprising at least one wall that defines a reservoir for storing fluid therein;

an output port in fluid communication with the reservoir; and a dispensing mechanism associated with the output port, the dispensing mechanism being selectively operable between a closed position and an opened position, wherein:

a first frangible area is disposed on the body on a diametrically opposite side of the reservoir relative to the output port, the at least one wall comprises a lower wall, an upper wall, and a side wall extending between the lower wall and the upper wall, the first frangible area is disposed on the upper wall, and a second frangible area is disposed on the lower wall, the second frangible area different from the output port.

18. The fluid container of claim 17, wherein:

the output port extends from the lower wall, and the second frangible area is laterally offset from the output port.

19. A fluid container, comprising:

a body comprising at least one wall that defines a reservoir for storing fluid therein;

an output port in fluid communication with the reservoir; and a dispensing mechanism associated with the output port, the dispensing mechanism being selectively operable between a closed position and an opened position, wherein:

a first frangible area is disposed on the body on a same side of the reservoir as the output port, and a second frangible area is disposed on the body on a diametrically opposite side of the reservoir relative to the output port and the first frangible area.

20. The fluid container of claim 19, wherein:

the output port extends from a lower wall of the body, and the first frangible area is disposed on the lower wall and laterally offset from the output port.

* * * * *